United States Patent [19]

Inoue et al.

[11] Patent Number: 4,948,434

[45] Date of Patent: Aug. 14, 1990

[54] METHOD FOR MANUFACTURING NI-FE ALLOY SHEET HAVING EXCELLENT DC MAGNETIC PROPERTY AND EXCELLENT AC MAGNETIC PROPERTY

[75] Inventors: Tadashi Inoue; Tomoyoshi Ohkita, both of Tokyo, Japan

[73] Assignee: NKK Corporation, Tokyo, Japan

[21] Appl. No.: 324,232

[22] Filed: Mar. 14, 1989

[30] Foreign Application Priority Data

Apr. 1, 1988 [JP] Japan ..... 63-78153

[51] Int. Cl.[5] ..... C21D 8/12; C22F 1/10

[52] U.S. Cl. ..... 148/120; 148/121; 148/11.5 A

[58] Field of Search ..... 148/120, 121, 11.5 N, 148/12 A; 420/458, 459

[56] References Cited

U.S. PATENT DOCUMENTS 3,989,555 11/1976 Yamagishi ..... 148/121
4,007,066 2/1977 Iijima et al. ..... 148/120

FOREIGN PATENT DOCUMENTS 2146755 3/1973 Fed. Rep. of Germany .
62-7017 2/1985 Japan .
62-227053 10/1987 Japan .
62-227054 10/1987 Japan .

OTHER PUBLICATIONS

Pfeifer et al., Zeitschrift fur Metallkunde, 70 (1979), No. 3, pp. 142–145.

*Primary Examiner*—Melvyn J. Andrews
*Assistant Examiner*—George Wyszomierski
*Attorney, Agent, or Firm*—Frishauf, Holtz, Goodman & Woodward

[57] ABSTRACT

A method for manufacturing an Ni-Fe alloy sheet having an excellent DC magnetic property and an excellent AC magnetic property, which comprises the steps of: hot-working a material consisting essentially of:

| | |
|---|---|
| nickel | from 76 to 81 wt. %, |
| molybdenum | from 3 to 5 wt. %, |
| copper | from 1.5 to 3.0 wt. %, |
| boron | from 0.0015 to 0.0050 wt. %, |

and the balance being iron and incidental impurities, to prepare an Ni-Fe alloy sheet; then subjecting the alloy sheet to a first cold-rolling at a reduction ratio of from 50 to 98%; then subjecting the alloy sheet to a first annealing in a temperature of from 780° to 950° C.; then subjecting the alloy sheet to a second cold-rolling at a reduction ratio of from 75 to 98%; and then subjecting the alloy sheet to a second annealing in a temperature of from 950° to 1,200° C.; thereby imparting an excellent DC magnetic property and an excellent AC magnetic property to the alloy sheet.

10 Claims, 5 Drawing Sheets

METHOD FOR MANUFACTURING NI-FE ALLOY SHEET HAVING EXCELLENT DC MAGNETIC PROPERTY AND EXCELLENT AC MAGNETIC PROPERTY

REFERENCE TO PATENTS, APPLICATIONS AND PUBLICATIONS PERTINENT TO THE INVENTION

As far as we know, there are available the following prior art documents pertinent to the present invention:

(1) Japanese Patent Provisional Publication No. 62-227,053 dated Oct. 6, 1987; and (2) Japanese Patent Provisional Publication No. 62-227,054 dated October 6, 1987.

The contents of the prior arts disclosed in the above-mentioned prior art documents will be discussed hereafter under the heading of the "BACKGROUND OF THE INVENTION."

1. Field of the Invention

The present invention relates to a method for manufacturing an Ni-Fe alloy sheet having an excellent DC magnetic property and an excellent AC magnetic property.

2. Background of the Invention

An Ni-Fe magnetic alloy corresponding to PC specified in JIS (abbreviation of Japanese Industrial Standards) (hereinafter referred to as "PC permalloy") is a magnetic material widely applied for a case and a core of a magnetic head, cores of various transformers, and various magnetic sealing materials.

The above-mentioned PC permalloy is characterized by a high magnetic permeability and a low coercive force. The highest value of magnetic permeability and the lowest value of coercive force of the PC permalloy practically used at present are as follows:

Initial magnetic permeability $\mu i$ : 80,000,

Maximum magnetic permeability $\mu m$ :280,000,

Effective magnetic permeability $\mu e$ : 15,000, and

Coercive force Hc : 0.010 (Oe).

However, the recent remarkable technical progress in the area of electronics has urged tendencies toward a smaller size and a higher performance of various devices and equipment, resulting in a demand for further improvement of a DC magnetic property and an AC magnetic property of the above-mentioned PC permalloy.

As Ni-Fe alloys having a high magnetic permeability, the following ones have been proposed:

(1) An Ni-Fe alloy having a high magnetic permeability, disclosed in Japanese Patent Provisional Publication No. 62-227,053 dated Oct. 6, 1987, which comprises:

| | | |
|---|---|---|
| nickel | from 70 | to 85 wt. %, |
| manganese | from 1.2 | to 10.0 wt. %, |
| molybdenum | from 1.0 | to 6.0 wt. %, |
| copper | from 1.0 | to 6.0 wt. %, |
| chromium | from 1.0 | to 5.0 wt. %, |
| boron | from 0.0020 | to 0.0150 wt. %, |

and the balance being iron and incidental impurities, where, the respective contents of sulfur, phosphorus and carbon as said incidental impurities being:

up to 0.005 wt.% for sulfur, up to 0.01 wt.% for phosphorus, and up to 0.01 wt.% for carbon.

(hereinafter referred to as the "prior art 1").

(2) An Ni-Fe alloy having a high magnetic permeability, disclosed in Japanese Patent Provisional Publication No. 62-227,054 dated Oct. 6, 1987, which comprises:

| | | |
|---|---|---|
| nickel | from 70 | to 85 wt. %, |
| manganese | up to 1.2 wt. %, | |
| molybdenum | from 1.0 | to 6.0 wt. %, |
| copper | from 1.0 | to 6.0 wt. %, |
| chromium | from 1.0 | to 5.0 wt. %, |
| boron | from 0.0020 | to 0.0150 wt. %, |

and the balance being iron and incidental impurities, where, the respective contents of sulfur, phosphorus and carbon as said incidental impurities being:

up to 0.005 wt.% for sulfur, up to 0.01 wt.% for phosphorus, and up to 0.01 wt.% and the ratio of the boron content to the total content of sulfur, phosphorus and carbon as said incidental impurities being within the range of from 0.08 to 7.0.

(hereinafter referred to as the "prior art 2").

The above-mentioned prior arts 1 and 2 involve the following problems: In the prior arts 1 and 2, as disclosed in the respective examples, the alloy having the above-mentioned chemical composition is hot-rolled to prepare an alloy sheet, and the thus prepared alloy sheet is subjected to a cold-rolling at a reduction ratio of 92%, and the alloy sheet thus applied with the cold-rolling is then subjected to an annealing in a temperature of 1,100° C. In the prior arts 1 and 2, however, only a single run of cold-rolling and a single run of annealing are applied, not followed by a second cold-rolling and a second annealing. As a result, the initial magnetic permeability is low as up to 60,000 in the prior art 1 and up to 100,000 in the prior art 2. Furthermore, the prior arts 1 and 2 do not teach the upper limits of the contents of oxygen and nitrogen, which are incidental impurities, whereas oxygen and nitrogen form oxide inclusions and nitride inclusions in the alloy, which in turn prevent transfer of the magnetic walls, and resulting in a lower magnetic permeability of the alloy. In addition, in the prior art 1, manganese is added in the alloy in an attempt to improve DC magnetic property. However, the high manganese content as within the range of from 1.2 to 10.0 wt.% results in a poor hot workability.

Under such circumstances, there is a strong demand for the development of a method for manufacturing an Ni-Fe alloy sheet having, as compared with the above-mentioned prior arts 1 and 2, a more excellent Dc magnetic property including an initial magnetic permeability $\mu i$ of at least 147,000 and preferably at least 150,000, a maximum magnetic permeability $\mu m$ of at least 280,000 and preferably at least 300,000 and a coercive force Hc of up to 0.009 Oersted (Oe), and a more excellent Ac magnetic property including an effective magnetic permeability $\mu e$ of at least 19,000 and a ratio of a residual magnetic flux density Br to a saturated magnetic flux density Bm in the magnetization hysteresis curve (hereinafter simply referred to as "Br/Bm ratio") of at least 0.90, but such a method has not as yet been proposed.

SUMMARY OF THE INVENTION

An object of the present invention is therefore to provide a method for manufacturing an Ni-Fe alloy sheet having an excellent DC magnetic property including an initial magnetic permeability $\mu i$ of at least 147,000 and preferably at least 150,000, a maximum magnetic permeability $\mu m$ of at least 280,000 and preferably at least 300,000 and a coercive force Hc of up to 0.009 (Oe), and an excellent Ac magnetic property including an effective magnetic permeability $\mu e$ of at least 19,000 and a Br/Bm ratio of at least 0.90.

In accordance with one of the features of the present invention, there is provided a method for manufacturing an Ni-Fe alloy sheet having an excellent Dc magnetic property, characterized by comprising the steps of:

using a material consisting essentially of:

| | | |
|---|---|---|
| nickel | from 75 | to 82 wt. %, |
| molybdenum | from 2 | to 6 wt. %, |
| boron | from 0.0015 | to 0.0050 wt. %, |

and the balance being iron and incidental impurities, where, the respective contents of sulfur, phosphorus, carbon, oxygen and nitrogen as said incidental impurities being:

up to 0.002 wt.% for sulfur,
up to 0.006 wt.% for phosphorus,
up to 0.01 wt.% for carbon.
up to 0.003 wt.% for oxygen, and
up to 0.0015 wt.% for nitrogen;

subjecting said material to a hot-working to prepare an Ni-Fe alloy sheet;

subjecting said alloy sheet thus prepared to a first cold-rolling at a reduction ratio within the range of from 50 to 98%;

subjecting said alloy sheet thus applied with said first cold-rolling to a first annealing in a temperature within the range of from 780 to 950 ° C;

subjecting said alloy sheet thus applied with said first annealing to a second cold-rolling at a reduction ratio within the range of from 75 to 98%; and subjecting said alloy sheet thus applied with said second cold-rolling to a second annealing in a temperature within the range of from 950° to 1,200° C;

thereby imparting an excellent DC magnetic property to said alloy sheet.

In accordance with another feature of the present invention, there is further provided a method for manufacturing an Ni-Fe alloy sheet having ah excellent DC magnetic property and an excellent AC magnetic property, characterized by comprising the steps of:

| | | |
|---|---|---|
| nickel | from 76 | to 81 wt. %, |
| molybdenum | from 3 | to 5 wt. %, |
| copper | from 1.5 | to 3.0 wt. %, |
| boron | from 0.0015 | to 0.0050 wt. %, |

and the balance being iron and incidental impurities, where, the respective contents of sulfur, phosphorus, carbon, oxygen and nitrogen as said incidental impurities being:

up to 0.002 wt.% for sulfur,
up to 0.006 wt.% for phosphorus,
up to 0.01 wt.% for carbon,
up to 0.003 wt.% for oxygen, and
up to 0.0015 wt.% for nitrogen;

subjecting said material to a hot-working to prepare an Ni-Fe alloy sheet;

subjecting said alloy sheet thus prepared to a first cold-rolling at a reduction ratio within the range of from 50 to 98%;

subjecting said alloy sheet thus applied with said first cold-rolling to a first annealing in a temperature within the range of from 780° to 950° C;

subjecting said alloy sheet thus applied with said first annealing to a second cold rolling at a reduction ratio within the range of from 75 to 98%; and subjecting said alloy sheet thus applied with said second cold-rolling to a second annealing in a temperature within the range of from 950° to 1,200° C;

thereby imparting an excellent Dc magnetic property and an excellent AC magnetic property to said alloy sheet.

DETAILED DESCRIPTION OF PREFERRED EMBODIMENTS

Figure 1A:
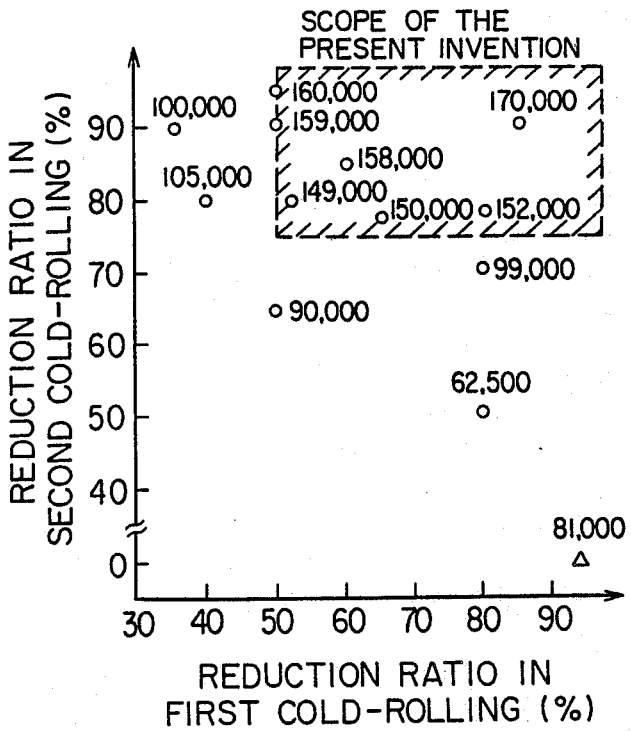
FIG. 1(A) is a graph illustrating the relationship between the initial magnetic permeability $\mu i$, the reduction ratio in the first cold-rolling and the reduction ratio in the second cold-rolling, in the Ni-Fe alloy sheet.

From the above-mentioned point of view, extensive studies were carried out to develop a method for manufacturing and Ni-Fe alloy sheet having, as compared with the above-mentioned prior arts 1 and 2, a more excellent DC magnetic property and a more excellent AC magnetic property. As a result, the following finding was obtained: By hot-working a material consisting essentially of:

| | | |
|---|---|---|
| nickel | from 75 | to 82 wt. %, |
| molybdenum | from 2 | to 6 wt. %, |
| boron | from 0.0015 | to 0.0050 wt. %, |

and the balance being iron and incidental impurities, to prepare an Ni-Fe alloy sheet; and by limiting the respective contents of sulfur, phosphorus, carbon, oxygen and nitrogen as the incidental impurities:

up to 0.002 wt.% for sulfur,
up to 0.006 wt.% for phosphorus,
up to 0.01 wt.% for carbon,
up to 0.003 wt.% for oxygen, and
up to 0.0015 wt.% for nitrogen;

and by subjecting the alloy sheet sequentially to a first cold-rolling at a reduction ratio of from 50 to 98%, a first annealing in a temperature of from 780° to 950° C, a second cold-rolling at a reduction ratio of from 75 to 98%, and a second annealing in a temperature of from 950° to 1,200° C; the direction of the recrystallized grains forming the recrystallization texture of the alloy sheet is controlled to a direction favorable for the magnetic property, resulting in a remarkable improvement of the DC magnetic property of the alloy sheet.

Furthermore, the following finding was obtained: by hot-working a material consisting essentially of:

| | | |
|---|---|---|
| nickel | from 76 | to 81 wt. %, |
| molybdenum | from 3 | to 5 wt. %, |
| copper | from 1.5 | to 3.0 wt. %, |
| boron | from 0.0015 | to 0.0050 wt. %, |

and the balance being iron and incidental impurities, to prepare an Ni-Fe alloy sheet; and by limiting the respective contents of sulfur, phosphorus, carbon, oxygen and nitrogen as the incidental impurities, as described above; and by subjecting the alloy sheet sequentially to the first cold-rolling, the first annealing, the second cold-rolling and the second annealing under the same conditions as those described above; the DC magnetic property of the alloy sheet is remarkably improved for the same reason as described above, and in addition, the AC magnetic property of the alloy sheet is largely improved.

The present invention was made on the basis of the above-mentioned findings and the method for manufacturing an Ni-Fe alloy sheet having an excellent DC magnetic property of the present invention comprises the steps of:

using a material consisting essentially of:

| | | |
|---|---|---|
| nickel | from 75 | to 82 wt. %, |
| molybdenum | from 2 | to 6 wt. %, |
| boron | from 0.0015 | to 0.0050 wt. %, |

and the balance being iron and incidental impurities, where, the respective contents of sulfur, phosphorus, carbon, oxygen and nitrogen as said incidental impurities being:

up to 0.002 wt.% for sulfur,
up to 0.006 wt.% for phosphorus,
up to 0.01 wt.% for carbon,
up to 0.003 wt.% for oxygen, and
up to 0.0015 wt.% for nitrogen;

subjecting said material to a hot-working to prepare an Ni-Fe alloy sheet;

subjecting said alloy sheet thus prepared to a first cold-rolling at a reduction ratio within the range of from 50 to 98%;

subjecting said alloy sheet thus applied with said first cold-rolling to a first annealing in a temperature within the range of from 780° to 950° C;

subjecting said alloy sheet thus applied with said first annealing to a second cold-rolling at a reduction ratio within the range of from 75 to 98%; and subjecting said alloy sheet thus applied with said second cold-rolling to a second annealing in a temperature within the range of from 950° to 1,200° C;

thereby imparting an excellent DC magnetic property to said alloy sheet.

The method for manufacturing an Ni-Fe alloy sheet having an excellent DC magnetic property and an excellent AC magnetic property of the present invention comprises the steps of:

using a material consisting essentially of:

| | |
|---|---|
| nickel | from 76 to 81 wt. %, |
| molybdenum | from 3 to 5 wt. %, |
| copper | from 1.5 to 3.0 wt. %, |
| boron | from 0.0015 to 0.0050 wt. %, |

and the balance being iron and incidental impurities, where, the respective contents of sulfur, phosphorus, carbon, oxygen and nitrogen as said incidental impurities being:

up to 0.002 wt.% for sulfur,
up to 0.006 wt.% for phosphorus,
up to 0.01 wt.% for carbon,
up to 0.003 wt.% for oxygen, and
up to 0.0015 wt.% for nitrogen;

subjecting said material to a hot-working to prepare an Ni-Fe alloy sheet;

subjecting said alloy sheet thus prepared to a first cold-rolling at a reduction ratio within the range of from 50 to 98%;

subjecting said alloy sheet thus applied with said first cold-rolling to a first annealing in a temperature within the range of from 780° to 950° C;

subjecting said alloy sheet thus applied with said first annealing to a second cold-rolling at a reduction ratio within the range of from 75 to 98%; and subjecting said alloy sheet thus applied with said second cold-rolling to a second annealing in a temperature within the range of from 950° to 1,200° C;

thereby imparting an excellent DC magnetic property and an excellent AC magnetic property to said alloy sheet.

Said material may further additionally contain as required at least one element selected from the group consisting of:

| | |
|---|---|
| manganese | from 0.10 to 0.60 wt. %, |
| and | |
| calcium | from 0.0007 to 0.0060 wt. %, |

Now, the following paragraphs describe the reasons why the chemical compositions of the materials are limited as described above in the method for manufacturing the Ni-Fe alloy sheet having an excellent DC magnetic property, and the Ni-Fe alloy sheet having an excellent DC magnetic property and an excellent AC magnetic property of the present invention.

(1) Nickel

Nickel is an element having an important effect on a DC magnetic permeability of the alloy. However, a nickel content of under 75 wt.% leads to a lower DC magnetic permeability. A nickel content of over 82 wt.% leads, on the other hand, also to a lower DC magnetic permeability. Furthermore, nickel, if contained in an amount of from 76 to 81 wt.%, has the function of increasing an effective magnetic permeability, a DC Br/Bm ratio and an AC Br/Bm ratio, under coexistence with molybdenum and copper. The nickel content should therefore be limited within the range of 75 to 82 wt.%. In addition, the nickel content should further be limited within the range of from 76 to 81 wt.% in order to particularly improve an AC magnetic property including the effective magnetic permeability and the AC Br/Bm ratio.

(2) Molybdenum

Molybdenum has the function of inhibiting the growth of $Ni_3Fe$ superlattice in an Ni-Fe alloy, and thus improving a DC magnetic permeability. However, with a molybdenum content of under 2 wt.%, a desired effect as described above cannot be obtained. A molybdenum content of over 6 wt.%, on the other hand, leads to a lower DC magnetic permeability. Furthermore, molybdenum, if contained in an amount of from 3 to 5 wt.%, has the function of improving an effective magnetic permeability, a DC Br/Bm ratio and an Ac Br/Bm ratio, under coexistence with nickel and copper. The molybdenum content should therefore be limited within the range of from 2 to 6 wt.%. In addition, the molybdenum content should further be limited within the range of from 3 to 5 wt.%, in order to particularly improve an AC magnetic property including the effective magnetic permeability and the AC Br/Bm ratio.

(3) Boron

Boron has the function of improving a hot-workability of the alloy. In addition, boron has the function, in a solid-solution state, of changing the direction of the recrystallized grains and other textural factors, which form the recrystallization texture of an Ni-Fe alloy, into a direction favorable for the magnetic property. However, with a boron content of under 0.0015 wt.%, a desired effect as mentioned above cannot be obtained. With a boron content of over 0.0050 wt.%, on the other hand, intermetallic compounds of boron are formed, thus deteriorating the magnetic property of the alloy. The boron content should therefore be limited within the range of from 0.0015 to 0.0050 wt.%.

(4) Copper

Copper never leads to a lower DC magnetic property of the alloy, and has the function of improving an effective magnetic permeability. Furthermore, copper has the function of improving a DC Br/Bm ratio and an AC Br/Bm ratio, under coexistence with nickel and molybdenum. However, with a copper content of under 1.5 wt.%, a desired effect as mentioned above cannot be obtained. A copper content of over 3.0 wt.%, on the other hand, leads to a lower effective magnetic permeability, a lower DC Br/Bm ratio and a lower AC Br/Bm ratio. The copper content should therefore be limited within the range of from 1.5 to 3.0 wt.%.

(5) Manganese

Manganese has the function of improving a hot-workability of the alloy. In the present invention, therefore, manganese is additionally added as required. With a manganese content of under 0.1 wt.%, however, a desired effect as described above cannot be obtained, and sulfur which is one of the incidental impurities, cannot be fixed. With a manganese content of over 0.60 wt.%, on the other hand, strength of the matrix becomes excessively high, and resulting in an easy occurrence of the grain boundary fracture. Therefore, the manganese content should be limited within the range of from 0.10 to 0.60 wt.%.

(6) Calcium

Calcium has the function of improving a hot-workability of the alloy. In the present invention, therefore, calcium is additionally added as required. With a calcium content of under 0.0007, however, a desired effect as described above cannot be obtained. A calcium content of over 0.0060 wt.%, on the other hand, leads to a lower magnetic property. Therefore, the calcium content should be limited within the range of from 0.0007 to 0.0060 wt.%.

(7) Sulfur

Sulfur is one of impurities inevitably entrapped into the alloy. Although the sulfur content should preferably be the lowest possible, it is difficult to largely reduce the sulfur content in an industrial scale from the economic point of view. A sulfur content of over 0.002 wt.% however deteriorates a hot-workability of the alloy and causes formation of sulfides in the alloy. Sulfides prevent transfer of the magnetic walls, and resulting in a lower magnetic property of the alloy. The above-mentioned sulfides furthermore prevent the recrystallized grains ( austenite), which form the recrystallization texture during the first annealing of the present invention, from coarsening during the second annealing of the present invention. As a result, the small particle size of the above-mentioned recrystallized grains (austenite) causes increase in a coercive force of the alloy. The sulfur content should therefore be limited to up to 0.002 wt.%, and more preferably to up to 0.001 wt.%.

(8) Phosphorus

Phosphorus is one of impurities inevitably entrapped into the alloy. Although the phosphorus content should preferably be the lowest possible, it is difficult to largely reduce the phosphorous content in an industrial scale from the economic point of view. A phosphorus content of over 0.006 wt.% however deteriorates a hot-workability of the alloy and prevents the direction of the recrystallized grains (austenite), which form the recrystallization texture during the first annealing of the present invention, from changing into a direction favorable for the magnetic property. Also with a phosphorus content of over 0.006 wt.%, the above-mentioned direction of the recrystallized grains does not sufficiently change into the direction favorable for the magnetic property during the second annealing of the present invention, resulting in a lower magnetic permeability of the alloy. The phosphorus content should therefore be limited to up to 0.006 wt.%.

(9) Carbon

Carbon is one of impurities inevitably entrapped into the alloy. Although the carbon content should preferably be the lowest possible, it is difficult to largely reduce the carbon content in an industrial scale from the economic point of view. A carbon content of over 0.01 wt.% however deteriorates a hot-workability and a magnetic property of the alloy. The carbon content should therefore be limited to up to 0.01 wt.%, and more preferably, to up to 0.004 wt.%.

(10) Oxygen

Oxygen is one of impurities inevitably entrapped into the alloy. Although the oxygen content should preferably be the lowest possible, it is difficult to largely reduce the oxygen content in an industrial scale from the economic point of view. An oxygen content of over 0.003 wt.% however causes formation of oxide inclusions in the alloy. The oxide inclusions prevent transfer of the magnetic walls, and resulting in a lower magnetic permeability of the alloy. In addition, the above-mentioned oxide inclusions prevent the recrystallized grains (austenite), which form the recrystallization texture during the first annealing of the present invention, from coarsening during the second annealing of the present invention. As a result, the small particle size of the above-mentioned recrystallized grains (austenite) causes increase in a coercive force of the alloy. The oxygen content should therefore be limited to up to 0.003 wt.%, and more preferably, to up to 0.002 wt.%.

(11) Nitrogen

Nitrogen is one of impurities inevitably entrapped into the alloy. Although the nitrogen content should preferably be the lowest possible, it is difficult to largely reduce the nitrogen content in an industrial scale from the economic point of view. With a nitrogen content of over 0.0015 wt.%, however, nitrogen is easily combined with boron in the alloy to form boron nitride (BN), thus reducing the amount of boron in the solid-solution state. In addition, the above-mentioned boron nitride (BN) prevents transfer of the magnetic walls, and resulting in a lower magnetic permeability. The nitrogen content should therefore be limited to up to 0.0015 wt.%, and more preferably, to up to 0.0010 wt.%.

In the method of the present invention, the alloy sheet having the chemical composition as described above is subjected to a first cold-rolling at a reduction ratio within the range of from 50 to 98%, then subjected to a first annealing in a temperature within the range of from 780° to 950° C, then subjected to a second cold-rolling at a reduction ratio within the range of from 75 to 98%, and then subjected to a second annealing in a temperature within the range of from 950° to 1,200° C.

The reasons why, in the method of the present invention, the reduction ratio in the first cold-rolling is limited within the range of from 50 to 98%, and the reduction ratio in the second cold-rolling is limited within the range of from 75 to 98%, are described below.

Ni-Fe alloy sheets of the present invention having the chemical composition as specified in the line of No. 1 in Table 1 presented later were subjected to a first cold-rolling while changing the reduction ratio within the range of from 30 to 98%, and the alloy sheets thus applied with the first cold-rolling were then subjected to a first annealing in a temperature within the range of from 780° to 950° C. The alloy sheets thus applied with the first annealing were then subjected to a second cold-rolling while changing the reduction ratio within the range of from 40 to 98% to prepare alloy sheet samples having a thickness of 0.15 mm. JIS rings having an outside diameter of 45 mm and an inside diameter of 33 mm were stamped out from the thus prepared alloy sheet samples and were used as test pieces. These test pieces were then subjected to a second annealing in a hydrogen atmosphere, which comprised: holding the test pieces at a temperature of 1,100° C for three hours, an then cooling same at a cooling rate of 100° C/hour.

For these test pieces thus applied with the second annealing, the relationship between an initial magnetic permeability $\mu i$ in the magnetic field of 0.005 Oersted (hereinafter referred to as "Oe"), a maximum magnetic permeability $\mu m$, a Br/Bm ratio in the magnetic field of a frequency of 50 Hz and 0.1 Oe, a reduction ratio in the first cold-rolling, and a reduction ratio in the second cold-rolling was investigated. The results are shown in FIGS. 1(A) to 1(C).

FIG. 1(A) is a graph illustrating the relationship between the initial magnetic permeability $\mu i$ and the reduction ratios in the first and second cold-rollings; FIG. 1(B) is a graph illustrating the relationship between the maximum magnetic permeability $\mu m$ and the reduction ratios in the first and second cold-rollings; and FIG. 1(C) is a graph illustrating the relationship between the Br/Bm ratio and the reduction ratios in the first and second cold-rollings. In FIGS. 1(A) to 1(C), the mark "o" represents the test pieces applied with both of the first and second cold-rollings, and the mark "Δ" represents the test pieces applied only with the first cold-rolling.

Figure 1B:
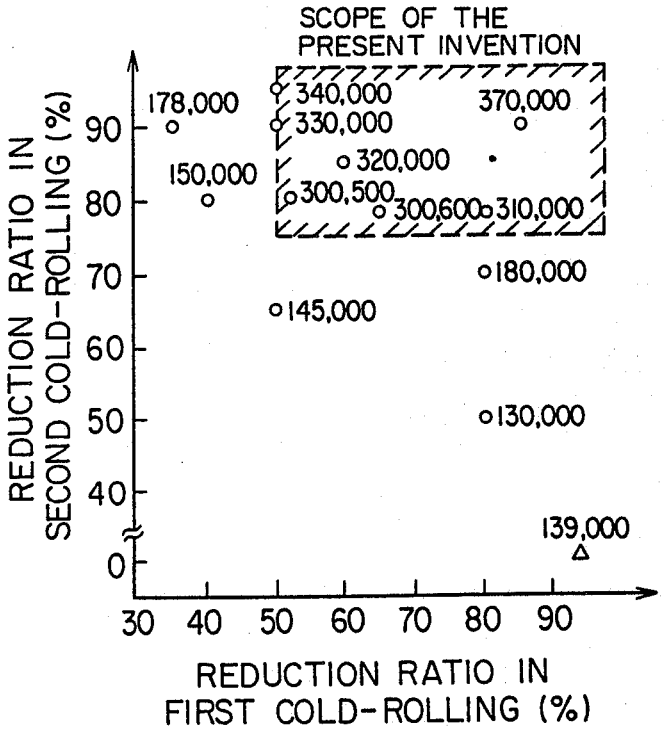
FIG. 1(B) is a graph illustrating the relationship between the maximum magnetic permeability $\mu m$, the reduction ratio in the first cold-rolling and the reduction ratio in the second cold-rolling, in the Ni-Fe alloy sheet.
Figure 1C:
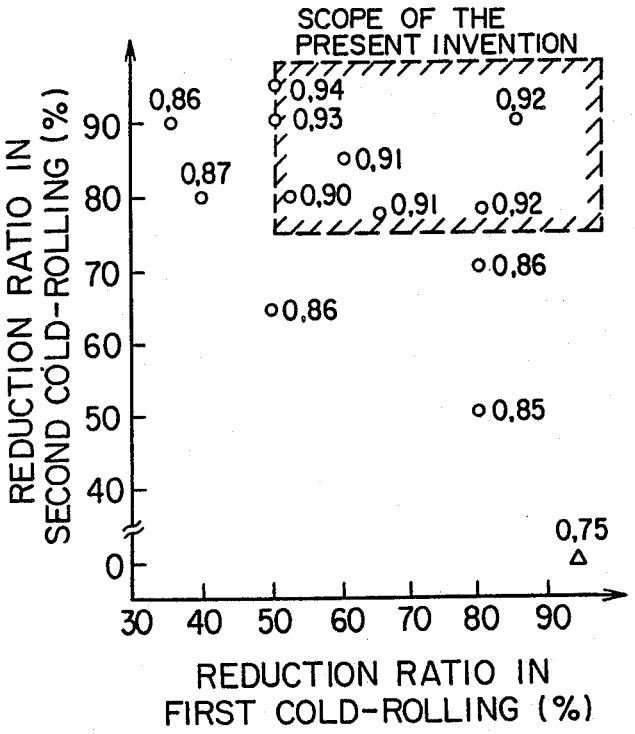
FIG. 1(C) is a graph illustrating the relationship between the Br/Bm ratio, the reduction ratio in the first cold-rolling and the reduction ratio in the second cold-rolling, in the Ni-Fe alloy sheet.

As is clear from FIGS. 1(A) to 1(C), the test pieces applied with the first cold-rolling at a reduction ratio of at least 50% and applied with the second cold-rolling at a reduction ratio of at least 75% have an excellent DC magnetic property and an excellent Ac magnetic property as demonstrated by an initial magnetic permeability $\mu i$ of at least 150,000, a maximum magnetic permeability $\mu m$ of at least 300,000, and a Br/Bm ratio of at least 0.90. This is attributable to the following fact: Application of the first cold-rolling at a reduction ratio of at least 50% facilitates the direction of the recrystallized grains (austenite) forming the recrystallization texture of the alloy sheet during the first annealing following the first cold-rolling to change into a direction favorable for the magnetic properties. Furthermore, application of the second cold-rolling at a reduction ratio of at least 75% facilitates further increase of the recrystallized grains having a direction favorable for the magnetic properties, which form the recrystallization texture during the second annealing following the second cold-rolling. Among the above-mentioned test pieces, those applied only with the first cold-rolling show a very poor initial magnetic permeability $\mu i$, a very poor maximum magnetic permeability $\mu m$ and a very poor Br/Bm ratio. When the reduction ratio in both of the first cold-rolling and the second cold-rolling is over 98%, an edge cracking of the alloy sheet and an excessively heavy mill load are caused during cold-rolling. In the present invention, therefore, the reduction ratio in the first cold-rolling is limited within the range of from 50 to 98%, and the reduction ratio in the second cold-rolling is limited within the range of from 75 to 98%.

Now, the reasons why, in the method of the present invention, the temperature in which the first annealing is carried out is limited within the range of from 780° to 950° C, and the temperature in which the second annealing is carried out is limited within the range of from 950° to 1,200° C, are described below.

Ni-Fe alloy sheets of the present invention having the chemical composition as specified in the line of No. 1 in Table 1 presented later were subjected to a first cold-rolling at a reduction ratio of 60%, and the alloy sheets thus applied with the first cold-rolling were subjected to a first annealing while changing the annealing temperature within the range of from 600° to 1,100° C. Then, the alloy sheets thus applied with the first annealing were subjected to a second cold-rolling at a reduction ratio of 85% to prepare alloy sheet samples having a thickness of 0.15 mm. JIS rings having an outside diameter of 45 mm and an inside diameter of 33 mm were stamped out from the thus prepared alloy sheet samples and were used as test pieces. These test pieces were then subjected to a second annealing in a hydrogen atmosphere, which comprised: holding the test pieces at a temperature of 1,100° C for three hours, and then cooling same at a cooling rate of 100° C/hour.

For these test pieces thus applied with the second annealing, the relationship being an initial magnetic permeability $\mu i$ in the magnetic field of 0.005 Oe, a maximum magnetic permeability $\mu m$, a Br/Bm ratio in the magnetic field of a frequency of 50 Hz and 0.1 Oe and an annealing temperature in the first annealing was investigated. The results are shown in FIG. 2(A) and 2(B).

Figure 2A:
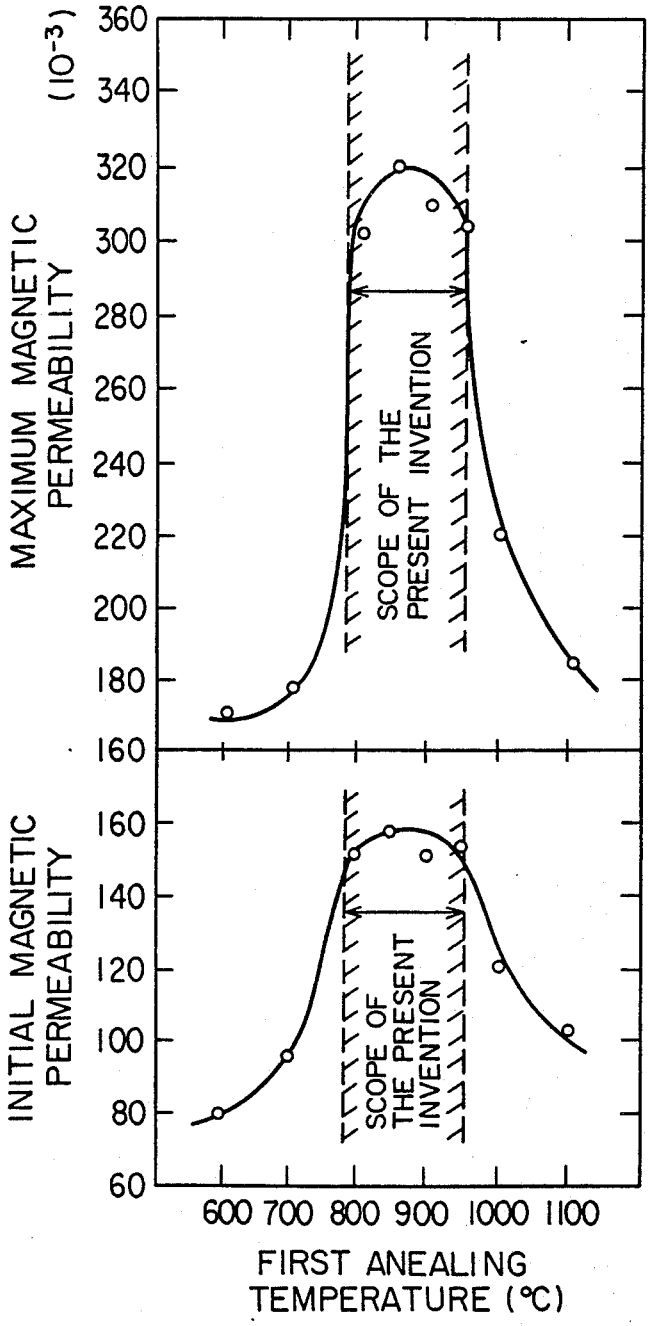
FIG. 2(A) is a graph illustrating the relationship between the initial magnetic permeability $\mu i$, the maximum magnetic permeability $\mu m$ and the annealing temperature in the first annealing, in the Ni-Fe alloy sheet.
Figure 2B:
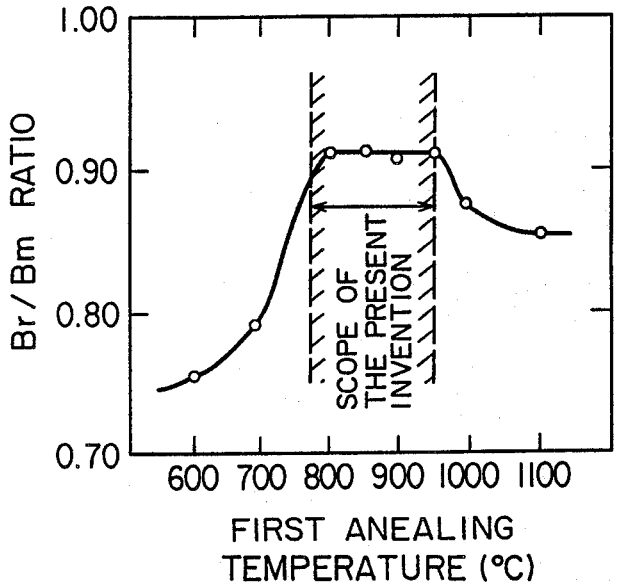
FIG. 2(B) is a graph illustrating the relationship between the Br/Bm ratio and the annealing temperature in the first annealing, in the Ni-Fe alloy sheet.

FIG. 2(A) is a graph illustrating the relationship between the initial magnetic permeability $\mu i$, the maximum magnetic permeability $\mu m$ and the annealing temperature in the first annealing; and FIG. 2(B) is a graph illustrating the relationship between the Br/Bm ratio and the annealing temperature in the first annealing.

As is clear from FIGS. 2(A) and 2(B), the test pieces applied with the first annealing at a temperature within the range of from 780° to 950° C, have an excellent Dc magnetic property and an excellent Ac magnetic property as demonstrated by an initial magnetic permeability $\mu i$ of at least 150,000, a maximum magnetic permeability $\eta i$ of at least 147,000 at temperatures of 780° C and 950° C and at least 150,000 at temperatures of from over 780° C to 950° C, a maximum magnetic permeability $\mu m$ of at least 280,000 at a temperature of 780° C and at least 300,000 at temperatures of from over 780° C to 950° C, and a Br/Bm ratio permeability $\mu m$ of at least 300,000, and a Br/Bm ratio of at least 0.90. This is attributable to the following fact: By the application of the first annealing in a temperature within the range of from 780° to 950° C, the alloy sheet is completely recrystallized, thus forming a recrystallization texture. In addition, the recrystallized grains forming the recrystallization texture, which are the austenitic state, have a small particle size, and most of the recrystallized grains have a direction favorable for the magnetic property under the cooperation of the effect of the special chemical composition of the alloy sheet of the present invention and the effect of the special first cold-rolling of the present invention. By subjecting the above-mentioned alloy sheet to a second cold-rolling at a reduction ratio within the scope of the present invention following the first annealing, and a second annealing in a temperature within the range of from 950° to 1,200° C, the alloy sheet forms again the recrystallization texture. In this recrystallization texture, the number of the recrystallized grains having the direction favorable for the magnetic property increases further under the effect of the second cold-rolling than the number of the recrystallized grains having the favorable direction for the magnetic property in the recrystallization texture formed during the first annealing, and the austenitic recrystallized grains having a small particle size formed during the first annealing are coarsened under the effect of the second annealing, resulting in a very high magnetic permeability. If the first annealing is applied in a temperature of under 780° C, the alloy sheet is not sufficiently recrystallized, leading to a smaller number of the recrystallized grains having the direction favorable for the magnetic property. Therefore, even by further applying the second cold-rolling and the second annealing as specified in the present invention, the number of the recrystallized grains having the direction favorable for the magnetic property remains small, resulting in a lower magnetic permeability. If the first annealing is applied in a temperature of over 950° C, on the other hand, the particle size of the austenitic recrystallized grains becomes coarser upon recrystallization of the alloy sheet. Therefore, when the second cold-rolling is applied to the alloy sheet following the first annealing, the direction of the recrystallized grains having already the direction favorable for the magnetic property, which have been formed during the first annealing, is caused to change, so that the number of the recrystallized grains having the direction favorable for the magnetic property does not increase even by application of the second annealing, resulting in a lower magnetic property. In the method of the present invention, therefore, the first annealing is carried out in a temperature within the range of from 780° to 950° C under the reason as described above.

Then, by applying the second annealing in a temperature within the range of 950 to 1,200° C, there is available, as described above, an increased number of the austenitic recrystallized grains having the direction favorable for the magnetic property in the recrystallization texture of the alloy sheet, and the recrystallized grains are coarsened. If the second annealing is applied in a temperature of under 950 ° C, coarsening of the recrystallized grains becomes insufficient, resulting in a lower magnetic permeability. If the second annealing is applied in a temperature of over 1,200° C, on the other hand, the crystallization texture becomes non-uniform, resulting in a lower magnetic permeability. In the present invention, therefore, the second annealing is carried out in a temperature within the range of from 950° to 1,200° C.

In the present invention, the above-mentioned material is first heated to a temperature within the range of from 1,000° to 1,300° C when preparing an Ni-Fe alloy sheet through hot-working. The thus heated material is hot-worked in a temperature of at least 800° C, and as required, the thus hot-worked material is subjected to the above-mentioned process comprising heating and the following hot-working more than once to prepare an Ni-Fe alloy sheet at a total reduction ratio of at least 90%.

The heating temperature of the material prior to the hot-working should be limited within the range of from 1,000° to 1,300° C for the following reason: When the material is heated to a temperature within the range of from 1,000° to 1,300° C, segregation of the constituent elements is eliminated, thus homogenizing the material. With a heating temperature of the material of under 1,000° C, a desired effect as described above cannot be obtained. With a heating temperature of the material of over 1,300° C, on the other hand, hot-workability is deteriorated.

The temperature in which hot-working is applied to the material should be limited to at least 800° C, because hot-workability of the material is deteriorated at a hot-working temperature of under 800° C. The reduction ratio in the hot-working should be limited to at least 90% for the following reason: At a reduction ratio of at least 90%, the alloy sheet is homogenized and the particle size of the recrystallized grains also becomes uniform. At a reduction ratio of under 90%, on the other hand, a desired effect as described above cannot be obtained. In the Ni-Fe alloy sheet of the present invention, homogenization of the alloy sheet and uniformity of the particle size of the recrystallized grains are required for the following reason: Since the alloy sheet of the present invention always has a single phase of austenite, if the constituent elements are segregated or the recrystallized grains have a non-uniform particle size when preparing the above-mentioned Ni-Fe alloy sheet, such segregation of the elements and non-uniformity of the particle size tend to remain as they are in the cold-rolling and the annealing of the present invention, thus resulting in a lower magnetic permeability of the alloy sheet.

Now, the method for manufacturing an Ni-Fe alloy sheet having an excellent DC magnetic property and an excellent Ac magnetic property of the present invention is described in more detail by means of examples.

EXAMPLE 1

Ni-Fe Alloys each having a chemical composition within the scope of the present invention as shown in Table 1, and Ni-Fe Alloys each having a chemical composition outside the scope of the present invention as shown also in Table 1, were melted by the vacuum melting, then cast into ingots. Subsequently, the resultant ingots were heated to a temperature of 1,000° C, then subjected to a hot-working at a temperature of at least 900° C and a descaling to prepare Ni-Fe alloy sheets. The alloy sheets thus obtained were subjected to a first cold-rolling at a reduction ratio of 60%, then subjected to a first annealing in a temperature of 850° C, and then subjected to a second cold-rolling at a reduction ratio of 85% to prepare alloy sheet samples having a thickness of 0.15 mm within the scope of the present invention (hereinafter referred to as the "Samples of the invention") Nos. 1 to 4, and alloy sheet samples also having a thickness of 0.15 mm outside the scope of the present invention (hereinafter referred to as the "samples for comparison")Nos. 5 to 12. Then, JIS rings having an outside diameter of 45 mm and an inside diameter of 33 mm were stamped out from the samples of the invention Nos. 1 to 4 and the samples for comparison Nos. 5 to 12 thus prepared and were used as test pieces. These test pieces were then subjected to a second annealing in a hydrogen atmosphere, which comprised; holding the test pieces at a temperature of 1,100° C for three hours, and then cooling same at a cooling rate of 100° C/hour.

For these test pieces thus applied with the second annealing, there were investigated a DC magnetic property including an initial magnetic permeability $\mu i$ in the magnetic field of 0.005 Oe, a maximum magnetic permeability $\mu m$, a coercive force Hc, a saturated magnetic flux density Bm10 in the magnetic field of 10 Oe, and a Br/Bm0.1 ratio in the magnetic field of 0.1 Oe; and an Ac magnetic property including an effective magnetic permeability $\mu e$ (i.e., an inductance magnetic permeability) in the magnetic field of a frequency of 1 KHz and 5 Oe, and a Br/Bm0.1 ratio in the magnetic field of a frequency of 50 Hz and 0.1 Oe. The results are shown in Table 2.

TABLE 1

| | No. | Ni | Mo | Cu | P | S | C | N | O | B | (wt. %) Others |
|---|---|---|---|---|---|---|---|---|---|---|---|
| Sample of the invention | 1 | 79.7 | 4.5 | 2.2 | 0.0010 | 0.0010 | 0.002 | 0.0004 | 0.0023 | 0.0042 | — |
| | 2 | 78.3 | 3.9 | 2.8 | 0.0010 | 0.0015 | 0.004 | 0.0010 | 0.0020 | 0.0030 | Mn: 0.54 |
| | 3 | 80.0 | 4.6 | — | 0.0030 | 0.0009 | 0.004 | 0.0008 | 0.0027 | 0.0025 | Mn: 0.51 |
| | 4 | 79.1 | 4.3 | 2.1 | 0.0030 | 0.0016 | 0.008 | 0.0007 | 0.0025 | 0.0042 | Ca: 0.0046 Mn: 0.55 |
| Sample for comparison | 5 | 79.6 | 4.5 | 2.2 | 0.0030 | 0.0032 | 0.001 | 0.0007 | 0.0014 | 0.0017 | Mn: 0.56 |
| | 6 | 78.0 | 4.0 | 2.5 | 0.0090 | 0.0019 | 0.007 | 0.0003 | 0.0020 | 0.0035 | Mn: 0.56 |
| | 7 | 78.2 | 5.2 | 2.7 | 0.0020 | 0.0003 | 0.005 | 0.0022 | 0.0051 | 0.0042 | Mn: 0.55 |
| | 8 | 80.1 | 4.9 | — | 0.0010 | 0.0011 | 0.005 | 0.0025 | 0.0025 | 0.0039 | Mn: 0.50 |
| | 9 | 79.5 | 4.4 | 2.9 | 0.0040 | 0.0012 | 0.006 | 0.0001 | 0.0023 | — | Mn: 0.56 |
| | 10 | 79.7 | 3.9 | 2.5 | 0.0030 | 0.0017 | 0.002 | 0.0009 | 0.0019 | 0.0010 | Mn: 0.60 |
| | 11 | 79.0 | 5.0 | — | 0.0040 | 0.0018 | 0.008 | 0.0011 | 0.0013 | 0.0070 | Mn: 0.53 |
| | 12 | 80.1 | 4.5 | 2.3 | 0.0040 | 0.0017 | 0.015 | 0.0008 | 0.0019 | 0.0044 | — |

TABLE 2

| | | DC Magnetic Property | | | | | AC magnetic property | |
|---|---|---|---|---|---|---|---|---|
| | No. | Initial magnetic permeability $\mu i$ | Maximum magnetic permeability $\mu m$ | Coercive force Hc (Oe) | Saturated magnetic flux density Bm10 (G) | Br/Bm 0.1 ratio | Effective magnetic permeability $\mu e$ | Br/Bm 0.1 ratio |
| Sample of the invention | 1 | 158,000 | 320,000 | 0.008 | 7,600 | 0.93 | 23,000 | 0.91 |
| | 2 | 150,000 | 310,000 | 0.009 | 7,400 | 0.92 | 22,000 | 0.91 |
| | 3 | 160,000 | 350,000 | 0.009 | 7,600 | 0.90 | 19,000 | 0.90 |
| | 4 | 152,000 | 315,000 | 0.009 | 7,500 | 0.93 | 22,000 | 0.92 |
| Sample for comparison | 5 | 97,000 | 178,000 | 0.012 | 7,300 | 0.87 | 15,000 | 0.86 |
| | 6 | 87,000 | 150,000 | 0.012 | 7,400 | 0.87 | 14,500 | 0.86 |
| | 7 | 57,500 | 127,500 | 0.013 | 7,700 | 0.79 | 16,000 | 0.79 |
| | 8 | 65,000 | 118,500 | 0.011 | 7,300 | 0.62 | 18,000 | 0.60 |
| | 9 | 62,500 | 135,000 | 0.013 | 7,300 | 0.81 | 16,000 | 0.80 |
| | 10 | 61,000 | 126,000 | 0.014 | 7,500 | 0.64 | 16,500 | 0.62 |
| | 11 | 65,000 | 119,000 | 0.014 | 7,300 | 0.84 | 16,000 | 0.83 |
| | 12 | 98,000 | 180,000 | 0.013 | 7,300 | 0.86 | 16,000 | 0.84 |

As is clear from Table 2, all the samples of the invention Nos. 1 to 3 have a very excellent DC magnetic property including the initial magnetic permeability $\mu i$ of at least 150,000, the maximum magnetic permeability $\mu m$ of at least 310,000, the coercive force Hc of up to 0.009 Oe and the Br/Bm0.1 ratio of at least 0.90, and also have a very excellent AC magnetic property including the effective magnetic permeability $\mu e$ of at least 19,000 and the Br/Bm0.1 ratio of at least 0.90. The sample of the invention No. 4 containing a slight amount of calcium also has an excellent DC magnetic property and an excellent AC magnetic property on the same level as the samples of the invention Nos. 1 to 3.

Each of the samples for comparison Nos. 5 to 8 has a high content outside the scope of the present invention of at least one of sulfur, phosphorus, oxygen and nitrogen, which are incidental impurities. Each of the samples for comparison Nos. 9 and 10 has a low boron content outside the scope of the present invention. The sample for comparison No. 11 has a high boron content outside the scope of the present invention. The sample for comparison No. 12 has a high content outside the scope of the present invention of carbon which is one of incidental impurities. As a result, all the samples for comparison Nos. 5 to 12 have a low DC magnetic property including the initial magnetic permeability $\mu i$ of up to 98,000, the maximum magnetic permeability $\mu m$ of up to 180,000, the coercive force Hc of at least 0.011, and the Br/Bm0.1 ratio of up to 0.87 and also have a low AC magnetic property including the effective magnetic permeability $\mu e$ of up to 18,000 and the Br/Bm0.1 ratio of up to 0.86.

As is evident from the above description, the Ni-Fe alloy sheets having the chemical composition outside the scope of the present invention have a very low DC magnetic property and also have a very low AC magnetic property even after application of the first and second cold-rollings and the first and second annealings within the scope of the present invention.

EXAMPLE 2

An Ni-Fe alloy having the same chemical composition as that of the sample of the invention No. 1 shown in Table 1 and an Ni-Fe alloy having the same chemical composition as that of the sample of the invention No. 3 shown also in Table 1 were melted by the vacuum melting, then cast into ingots. Subsequently, the resultant ingots were heated and subjected to a hot-working under the same conditions as those in Example 1 to prepare Ni-Fe alloy sheets. The alloy sheets thus obtained were subjected to a first cold-rolling, a first annealing and a second cold-rolling under the conditions as shown in Table 3 to prepare alloy sheet samples having a thickness of 0.15 mm. Then, JIS rings having an outside diameter of 45 mm and an inside diameter of 33 mm were stamped out from the alloy sheet samples thus prepared and were used as test pieces Nos. 1 to 16. These test pieces Nos. 1 to 16 were then subjected to a second annealing in a hydrogen atmosphere, which comprised; holding the test pieces at a temperature of 1,100° C for three hours, and cooling same at a cooling rate of 100° C/hour.

For these test pieces Nos. 1 to 16 thus applied with the second annealing, there were investigated a DC magnetic property including an initial magnetic permeability $\mu i$, a maximum magnetic permeability $\mu m$, a coercive force Hc, and a saturated magnetic flux density Bm10; and a AC magnetic property including an effective magnetic permeability $\mu e$ and a Br/Bm0.1 ratio, under the same conditions as in Example 1. The results are shown also in Table 3.

TABLE 3

| | | | | | DC magnetic Property | | | | AC magnetic property | |
|---|---|---|---|---|---|---|---|---|---|---|
| Sample No. | Test piece No. | Reduction ratio in 1st cold-rolling (%) | 1st. annealing temperature (°C.) | Reduction ratio in cold-rolling (%) | Initial magnetic permeability $\mu i$ | Maximum magnetic permeability $\mu m$ | Coercive force Hc (Oe) | Saturated magnetic flux density Bm 10 (G) | Effective magnetic permeability $\mu e$ | Br/Bm 0.1 ratio |
| Sample of the invention | | | | | | | | | | |
| 1 | 1 | 60 | 850 | 85 | 158,000 | 320,000 | 0.008 | 7,600 | 23,000 | 0.91 |
| | 2 | 50 | 870 | 90 | 159,000 | 330,000 | 0.008 | 7,500 | 24,000 | 0.93 |
| | 3 | 80 | 900 | 78 | 152,000 | 310,000 | 0.009 | 7,500 | 22,000 | 0.92 |
| 3 | 4 | 55 | 850 | 87 | 160,000 | 345,000 | 0.009 | 7,600 | 19,500 | 0.90 |
| | 5 | 75 | 900 | 80 | 156,000 | 340,000 | 0.009 | 7,600 | 19,000 | 0.90 |
| | 6 | 82 | 870 | 75 | 154,000 | 335,000 | 0.009 | 7,500 | 19,000 | 0.90 |
| Sample for comparison | | | | | | | | | | |
| 1 | 7 | 80 | 850 | 70 | 99,000 | 180,000 | 0.012 | 7,400 | 16,000 | 0.86 |
| | 8 | 60 | 700 | 85 | 96,000 | 178,000 | 0.013 | 7,500 | 15,500 | 0.78 |
| | 9 | 60 | 1,000 | 85 | 120,000 | 220,000 | 0.011 | 7,500 | 17,000 | 0.88 |
| | 10 | 35 | 870 | 90 | 100,000 | 178,000 | 0.011 | 7,400 | 16,500 | 0.86 |
| | 11 | 95 | — | — | 81,000 | 139,000 | 0.013 | 7,500 | 16,000 | 0.75 |
| 3 | 12 | 85 | 850 | 60 | 100,000 | 170,000 | 0.012 | 7,500 | 16,500 | 0.85 |
| | 13 | 65 | 650 | 84 | 90,000 | 185,000 | 0.011 | 7,400 | 17,000 | 0.78 |
| | 14 | 65 | 1,000 | 84 | 122,000 | 230,000 | 0.011 | 7,400 | 17,000 | 0.84 |
| | 15 | 40 | 870 | 90 | 112,000 | 208,000 | 0.012 | 7,500 | 16,500 | 0.85 |
| | 16 | 85 | — | — | 85,000 | 163,000 | 0.012 | 7,400 | 16,500 | 0.75 |

As is clear from Table 3, all the test pieces Nos. 1 to 6 subjected to the first and second cold-rollings at the reduction ratios within the scope of the present invention and subjected to the first and second annealings in the temperatures within the scope of the present invention, have a very excellent DC magnetic property including the initial magnetic permeability $\mu i$ of at least 152,000, the maximum magnetic permeability $\mu m$ of at least 310,000, and the coercive force Hc of up to 0.009 Oe, and also have a very excellent AC magnetic property including the effective magnetic permeability $\mu e$ of at least 19,000 and the Br/Bm0.1 ratio of at least 0.90.

In contrast, the test pieces Nos. 7 and 12 were subjected to a second cold-rolling at a low reduction ratio outside the scope of the prevent invention. The test pieces Nos. 8 and 13 were subjected to a first annealing in a low temperature outside the scope of the present invention. The test pieces Nos. 9 and 14 were subjected to a first annealing in a high temperature outside the scope of the present invention. The test pieces Nos. 10 and 15 were subjected to a first cold-rolling at a low reduction ratio outside the scope of the present invention.

As a result, all test pieces for comparison Nos. 7 to 10 and 12 to 15 outside the scope of the present invention have a low DC magnetic property including the initial magnetic permeability $\mu i$ of up to 122,000, the maximum magnetic permeability $\mu m$ of up to 230,000 and the coercive force Hc of at least 0.011 Oe, and also have a low AC magnetic property including the effective magnetic permeability $\mu e$ *of up to* 17,000 and the Br/Bm0.1 ratio of up to 0.88, although these test pieces Nos. 7 to 10 and 12 to 15 have the chemical composition within the scope of the present invention.

The test pieces Nos. 11 and 16 outside the scope of the present invention were subjected to only a single run of cold-rolling. As a result, the test pieces Nos. 11 and 16 have a very low DC magnetic property including the initial magnetic permeability $\mu i$ of up to 85,000, the maximum magnetic permeability $\mu m$ of up to 163,000 and the coercive force Hc of at least 0.012 Oe, and, also have a very low Ac magnetic property including the effective magnetic permeability $\mu e$ of up to 16,500 and the Br/Bm0.1 ratio of up to 0.75.

As is evident from the above description, even if an Ni-Fe alloy sheet has a chemical composition within the scope of the present invention, the alloy sheet has a very low DC magnetic property and a very low AC magnetic property, unless the alloy sheet is subjected to the first and second cold-rollings at the reduction ratios within the scope the present invention, and subjected to the first and second annealings in the temperatures within the scope of the present invention.

The process of preparing an Ni-Fe alloy sheet before applying the above-mentioned first cold-rolling is not limited to the process described in Examples 1 and 2, but the above-mentioned material may be melted by the vacuum melting, cast into a thin slab and used as-cast, or may further be subjected to a hot-rolling to prepare the alloy sheet.

According to the method of the present invention, as described above in detail, it is possible to manufacture an Ni-Fe alloy sheet having an excellent DC magnetic property and an excellent AC magnetic property, and the thus manufactured alloy sheet is applicable as a magnetic material for a magnetic amplifier, a pulse transformer and the like, which requires a more excellent DC magnetic property and a more excellent AC magnetic property, thus providing industrially useful effect.

What is claimed is:

1. A method for manufacturing a Ni-Fe alloy sheet having excellent Dc magnetic properties, comprising the sequential steps of:

providing a material consisting essentially of:

| | |
|---|---|
| nickel | from 75 to 82 wt. %, |
| molybdenum | from 2 to 6 wt. %, |
| boron | from 0.0015 to 0.0050 wt. %, |

and the balance being iron and incidental impurities, where the respective contents of sulfur, phosphorus, carbon, oxygen and nitrogen as said incidental impurities being:

up to 0.002 wt.% for sulfur,
up to 0.006 wt.% for phosphorus,
up to 0.01 wt.% for carbon,
up to 0.003 wt.% for oxygen, and
up to 0./0015 wt.% for nitrogen;

hot-working said material to form a Ni-Fe alloy sheet;

cold-rolling said alloy sheet at a reduction ratio of from 50 to 98%;

annealing said cold-rolled alloy sheet at a temperature of from 780° to 950° C;

cold-rolling said annealed sheet at a reduction ratio of from 75 to 98%; and annealing said twice cold-rolled alloy sheet at a temperature of from 950° to 1,200° C;

to form an alloy sheet having the excellent DC magnetic properties of an initial magnetic permeability of at least 147,000, a maximum magnetic permeability of at least 280,000 and a coercive force of up to 0.009 (Oe).

2. The method as claimed in claim 1, wherein:

said material additional contains at least one element selected from the group consisting of:

| | |
|---|---|
| manganese | from 0.10 to 0.60 wt. %, |
| and | |
| calcium | from 0.0007 to 0.0060 wt. %. |

3. The method as claimed in claim 2, wherein said material consists essentially of 80.0% Ni, 4.6% Mo, 0.0030% P, 0.0009% S, 0.004% C, 0.0008% N, 0.0027% O, 0.0025% B, 0.51% Mn and the balance Fe.

4. The method as claimed in claim 1, wherein said initial magnetic permeability is at least 150,000 and said maximum magnetic permeability is at least 300,000.

5. The method for manufacturing a Ni-Fe alloy sheet having excellent Dc magnetic properties and excellent AC magnetic properties, comprising the sequential steps of:

providing a material consisting essential of:

| | |
|---|---|
| nickel | from 76 to 81 wt. %, |
| molybdenum | from 3 to 5 wt. %, |
| copper | from 1.5 to 3.0 wt. %, |
| boron | from 0.0015 to 0.0050 wt. %, |

and the balance being iron and incidental impurities, where, the respective contents of sulfur, phosphorus, carbon, oxygen and nitrogen as said incidental impurities being:

up to 0.002 wt.% for sulfur,
up to 0.0006 wt.% for phosphorus,
up to 0.02 wt.% for carbon,
up to 0.003 wt.% for oxygen, and
up to 0.0015 wt.% for nitrogen;

hot-working said material to form a Ni-Fe alloy sheet;

cold-rolling said alloy sheet at a reduction ratio of from 50 to 98%.

annealing said cold-rolled alloy sheet at a temperature of from 780° to 950° C;

cold-rolling said annealed alloy sheet at a reduction ratio of from 75 to 98%, and annealing said twice cold-rolled alloy sheet at a temperature of from 950° to 1,200° C;

to form an alloy sheet having the excellent DC magnetic properties of an initial magnetic permeability of at least 147,000, a maximum magnetic permeability of at least 280,000 and a coercive force of up to 0.009 (Oe) and the excellent AC magnetic properties of an effective magnetic permeability of at least 19,000 and a Br/Bm ratio of at least 0.90.

6. The method as claimed in claim 5, wherein:

said material additionally contains at least one element selected from the group consisting of: manganese: from 0.10 to 0.60 wt.%, and calcium: from 0.0007 to 0.0060 wt.%.

7. The method as claimed in claim 6, wherein said material consists essentially of 78.3%, Ni, 3.9% Mo, 2.8% Cu, 0.0010% P, 0.0015% S, 0.004% C, 0.0010% N, 0.0020T O, 0.0030% B, 0.54% Mn and the balance Fe.

8. The method as claimed in claim 6, wherein said material consists essentially of 79.1% Ni, 4.3% Mo, 2.1% /cu, 0.0030% P, 0.0016% S, 0.008% C, 0.0007% N, 0.0025% O, 0.0042% B, 0.0046% Ca, 0.55% Mn and the balance Fe.

9. The method as claimed in claim 5, wherein said material consists essentially of 79.7% Ni, 4.5% Mo, 2.2% Cu, 0.0010% P, 0.0010% S, 0.002% C, 0.0004% N, 0.0023% O, 0.0042% B and the balance Fe.

10. The method as claimed din claim 5, wherein said initial magnetic permeability is at least 150,000 and said maximum magnetic permeability is at least 300,000.

* * * * *

UNITED STATES PATENT AND TRADEMARK OFFICE

CERTIFICATE OF CORRECTION

PATENT NO. : 4,948,434

DATED : August 14, 1990

INVENTOR(S) : INOUE et al

It is certified that error appears in the above-identified patent and that said Letters Patent is hereby corrected as shown below:

Column 17, line 49 (Claim 1, line 10):

after "where", insert --,--.

Column 17, line 56 (Claim 1, line 17):

change "0./0015" to --0.0015--.

Column 18, line 5 (Claim 2, line 2):

change "additional" to --additionally--.

Column 18, line 19 (Claim 5,line 1):

change "The" to --A--.

Column 18, line 36 (Claim 5, line 16):

change "0.0006" to --0.006--.

Column 18, line 37 (Claim 5, line 17):

change "0.02" to --0.01--.

Column 18, line 47 (Claim 5, line 27):

after "98%", change "," to --;--.

UNITED STATES PATENT AND TRADEMARK OFFICE

CERTIFICATE OF CORRECTION

PATENT NO. : 4,948,434

DATED : August 14, 1990

INVENTOR(S) : INOUE et al

It is certified that error appears in the above-identified patent and that said Letters Patent is hereby corrected as shown below:

Column 18, line 63 (Claim 7, line 2):

after "78.3%", delete ",".

Column 18, line 65 (Claim 7, line 4):

change "T" to --%--.

Signed and Sealed this

Twenty-second Day of December, 1992

*Attest:*

DOUGLAS B. COMER

*Attesting Officer*

*Acting Commissioner of Patents and Trademarks*